US009664052B2

(12) United States Patent
Delvaux et al.

(10) Patent No.: US 9,664,052 B2
(45) Date of Patent: May 30, 2017

(54) TURBINE COMPONENT, TURBINE BLADE, AND TURBINE COMPONENT FABRICATION PROCESS

(71) Applicant: GENERAL ELECTRIC COMPANY, Schenectady, NY (US)

(72) Inventors: John McConnell Delvaux, Fountain Inn, SC (US); Ronald Ralph Cairo, Simpsonville, SC (US); Jason Robert Parolini, Greer, SC (US)

(73) Assignee: General Electric Company, Schenectady, NY (US)

( * ) Notice: Subject to any disclaimer, the term of this patent is extended or adjusted under 35 U.S.C. 154(b) by 927 days.

(21) Appl. No.: 13/633,928

(22) Filed: Oct. 3, 2012

(65) Prior Publication Data

US 2014/0093381 A1 Apr. 3, 2014

(51) Int. Cl.
*F01D 5/14* (2006.01)
*F01D 5/28* (2006.01)

(52) U.S. Cl.
CPC ..... *F01D 5/282* (2013.01); *F01D 5/288* (2013.01); *F05D 2220/30* (2013.01); *F05D 2260/941* (2013.01); *F05D 2300/2261* (2013.01); *F05D 2300/6012* (2013.01); *F05D 2300/6033* (2013.01); *Y10T 29/49336* (2015.01)

(58) Field of Classification Search
CPC ..... F01D 5/282; F01D 5/284
See application file for complete search history.

(56) References Cited

U.S. PATENT DOCUMENTS 3,731,360 A 5/1973 Stone, Jr.
3,752,600 A 8/1973 Walsh et al.
5,308,228 A * 5/1994 Benoit ..... B29C 70/543 156/93
7,066,717 B2 * 6/2006 Morrison ..... F01D 5/187 29/889.71

(Continued)

FOREIGN PATENT DOCUMENTS

EP 1555391 A2 7/2005
EP 1676822 A2 7/2006
FR WO 2010116066 A1 * 10/2010 ..... B29C 70/24

OTHER PUBLICATIONS

A European Search Report and Written Opinion issued in connection with corresponding EP Application No. 13179096.6-1610 on Oct. 2, 2014.

*Primary Examiner* — Richard Edgar
(74) *Attorney, Agent, or Firm* — McNees Wallace & Nurick LLC

(57) ABSTRACT

A turbine component, a turbine blade, and a turbine component fabrication process are disclosed. The turbine component includes ceramic matrix composite plies and a feature configured for preventing interlaminar tension of the ceramic matrix composite plies. The feature is selected from the group consisting of ceramic matrix composite tows or precast insert tows extending through at least a portion of the ceramic matrix composite plies, a woven fabric having fiber tows or a precast insert preventing contact between a first set of the ceramic matrix composite plies and a second set of the ceramic matrix composite plies, and combinations thereof. The process includes laying up ceramic matrix composite plies in a preselected arrangement and securing a feature configured for interlaminar tension.

19 Claims, 6 Drawing Sheets

(56) References Cited

U.S. PATENT DOCUMENTS

| | | | | |
|---|---|---|---|---|
| 7,310,949 | B2 | 12/2007 | Carper | |
| 7,600,978 | B2 * | 10/2009 | Vance | F01D 5/147 416/230 |
| 7,754,126 | B2 | 7/2010 | Subramanian | |
| 8,114,799 | B2 | 2/2012 | Subramanian | |
| 8,607,454 | B2 * | 12/2013 | Blanchard | B29C 70/24 156/148 |
| 8,834,125 | B2 * | 9/2014 | Alvanos et al. | 416/220 R |
| 2005/0158171 | A1 * | 7/2005 | Carper | B32B 18/00 415/200 |
| 2006/0283014 | A1 * | 12/2006 | Subramanian | C04B 35/573 29/889.71 |
| 2010/0015394 | A1 | 1/2010 | Morrison et al. | |
| 2013/0011271 | A1 * | 1/2013 | Shi | F01D 5/28 416/230 |

* cited by examiner

TURBINE COMPONENT, TURBINE BLADE, AND TURBINE COMPONENT FABRICATION PROCESS

STATEMENT REGARDING FEDERALLY SPONSORED RESEARCH OR DEVELOPMENT

The United States Government retains license rights in this invention and the right in limited circumstances to require the patent owner to license others on reasonable terms by the terms of Government Contract No. DE-FC26-05NT42643 awarded by the United Stated Department of Energy.

FIELD OF THE INVENTION

The present invention is directed to turbine components and fabrication processes. More particularly, the present invention is directed to ceramic matrix composite components and ceramic matrix composite component fabrication processes.

BACKGROUND OF THE INVENTION

In order to increase the efficiency and the performance of gas turbines so as to provide increased power generation, lower emissions and improved specific fuel consumption, turbines are tasked to operate at higher temperatures and under harsher conditions. Such conditions become a challenge for cooling of certain materials.

As operating temperatures have increased, new methods of cooling alloys have been developed. For example, ceramic thermal barrier coatings (TBCs) are applied to the surfaces of components in the stream of the hot effluent gases of combustion to reduce the heat transfer rate and to provide thermal protection to the underlying metal and allow the component to withstand higher temperatures. Also, cooling holes are used to provide film cooling to improve thermal capability or protection. Concurrently, ceramic matrix composites (CMCs) have been developed as substitutes for some alloys. The CMCs provide more desirable temperature and density properties in comparison to some metals; however, they present additional challenges.

A number of techniques have been used in the past to manufacture turbine components having CMCs. For example, SiC/SiC CMCs have been formed from 2-D ceramic fiber plies. However, such materials have inherently low interlaminar properties. In many applications, thermal gradients and mechanical loads that result from operation result in significant local interlaminar stresses.

One known technique of handling interlaminar stresses includes use of ceramic matrix pins/plugs. In that technique, the matrix-only pins/pugs that do not include fibers can be susceptible to fast-fracture and can lack toughness.

Another known technique includes a splay that partially separates a pressure side and a suction side of a turbine blade in the root. In that technique, the load path is not completely separated because the splay is limited to the root and the blade is a solid (not hollow) blade. This results in limitations on reducing, relieving, or eliminating the interlaminar stresses. In addition, such techniques are limited to in-plane stresses and do not include properties associated with transverse features, such as, weaves or tows.

A turbine component, a turbine blade, and a turbine component fabrication process that do not suffer from one or more of the above drawbacks would be desirable in the art.

BRIEF DESCRIPTION OF THE INVENTION

In an exemplary embodiment, a turbine component includes ceramic matrix composite plies and a feature configured for preventing interlaminar tension of the ceramic matrix composite plies. The feature is selected from the group consisting of ceramic matrix composite tows or precast insert tows extending through at least a portion of the ceramic matrix composite plies, a woven fabric having fiber tows or a precast insert preventing contact between a first set of the ceramic matrix composite plies and a second set of the ceramic matrix composite plies, and combinations thereof.

In another exemplary embodiment, a turbine blade includes ceramic matrix composite plies and a feature configured for preventing interlaminar tension. The feature includes precast insert tows extending through the ceramic matrix composite plies and a precast insert preventing contact between a first set of the ceramic matrix composite plies and a second set of the ceramic matrix composite plies.

In another exemplary embodiment, a turbine component fabrication process includes laying up ceramic matrix composite plies in a preselected arrangement and securing a feature configured for interlaminar tension. The feature is selected from the group consisting of ceramic matrix composite tows or precast insert tows extending through the ceramic matrix composite plies, a woven fabric having fiber tows or a precast insert preventing contact between a first set of the ceramic matrix composite plies and a second set of the ceramic matrix composite plies, and combinations thereof.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is an exemplary turbine component and an exemplary turbine component fabrication process. Embodiments of the present disclosure permit operation of turbines at higher temperature with reduced effect (for example, from interlaminar forces), permit increased efficiency of turbines, permit interlaminar stresses to be relieved, reduced, eliminated and/or compensated for, reduce or eliminate fast-fracture, permit increased toughness of turbine components, permit out-of-plane forces to be relieved, reduces, eliminated, and/or compensated for, and combinations thereof. For example, in one embodiment, the presence of additional boundaries oriented perpendicular to a plane of a blade's radial fiber orientation provides a form of damage tolerance for cracks growing in the plane of the radial (primary structural loading) fibers. The damage tolerance is provided because a crack growing in the plane of the radial reinforcement plies reaches a boundary of transversely penetrating tows and stops. The presence of multiple penetrating tows creates additional damage tolerance for cracks growing between the tows. So, in addition to providing more robustness through the thickness of a neck for interlaminar separation, the damage tolerance for cracks growing in the plane of the primary reinforcing layers of the airfoil in the transition region of an attachment is provided.

Figure 1:
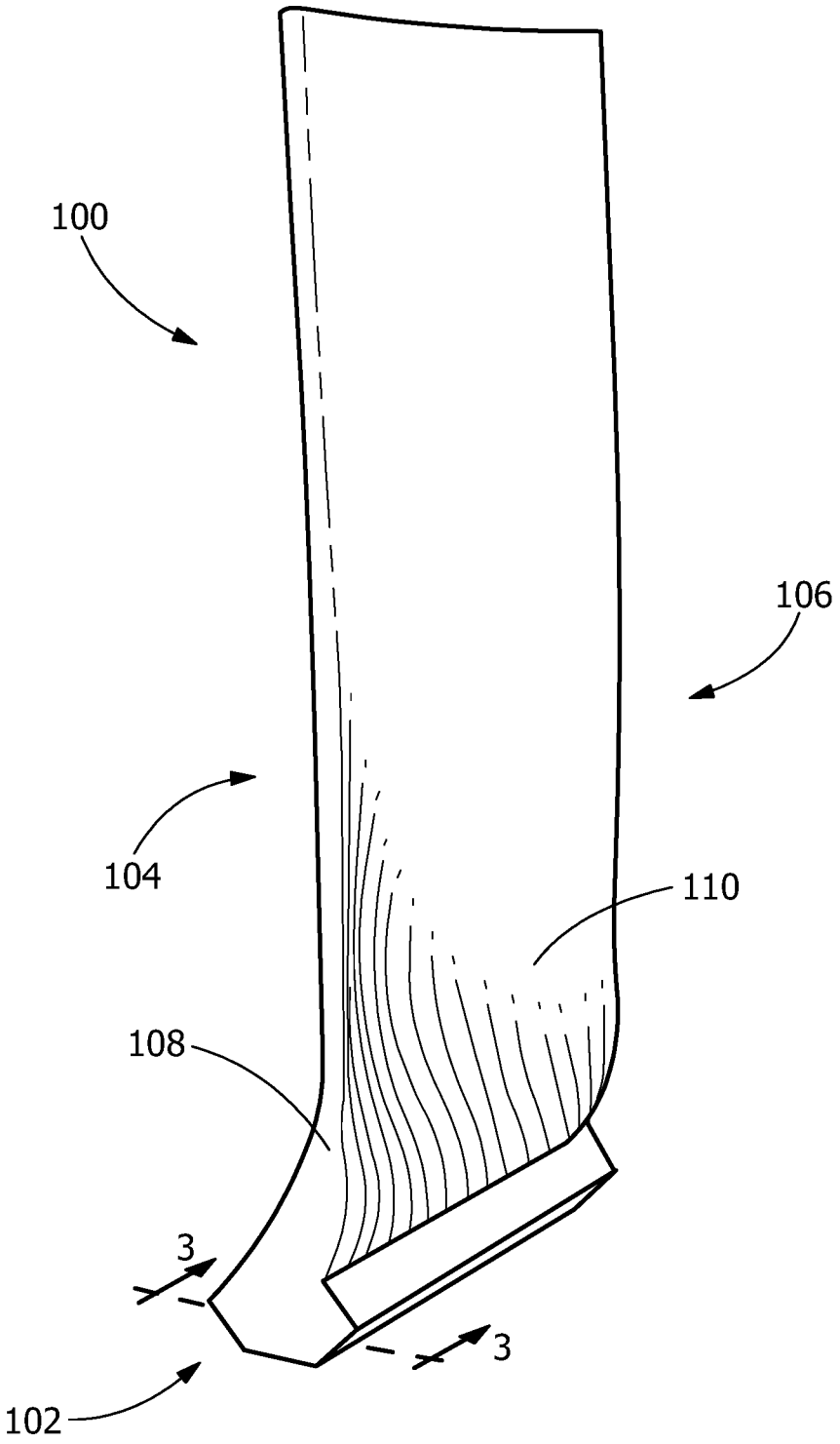
FIG. 1 is a perspective view of an exemplary turbine component according to the disclosure.

FIG. 1 shows a perspective view of an embodiment of a turbine component according to the disclosure. The turbine component is any suitable turbine component or portion of a turbine component. Suitable turbine components include, but are not limited to, a blade 100 (as is shown in FIG. 1), a dovetail, a shank, a platform, a tip cap, a fir-tree, and combinations thereof. The turbine component includes ceramic matrix plies 302, for example, including silicon carbide or any other suitable ceramic material, and a feature 304 configured for preventing interlaminar tension of the ceramic matrix composite plies 302, as is further shown and described below with reference to FIGS. 3-6. The turbine component, such as the turbine blade 100, is solid or hollow, for example, including one or more cavities.

Figure 2:
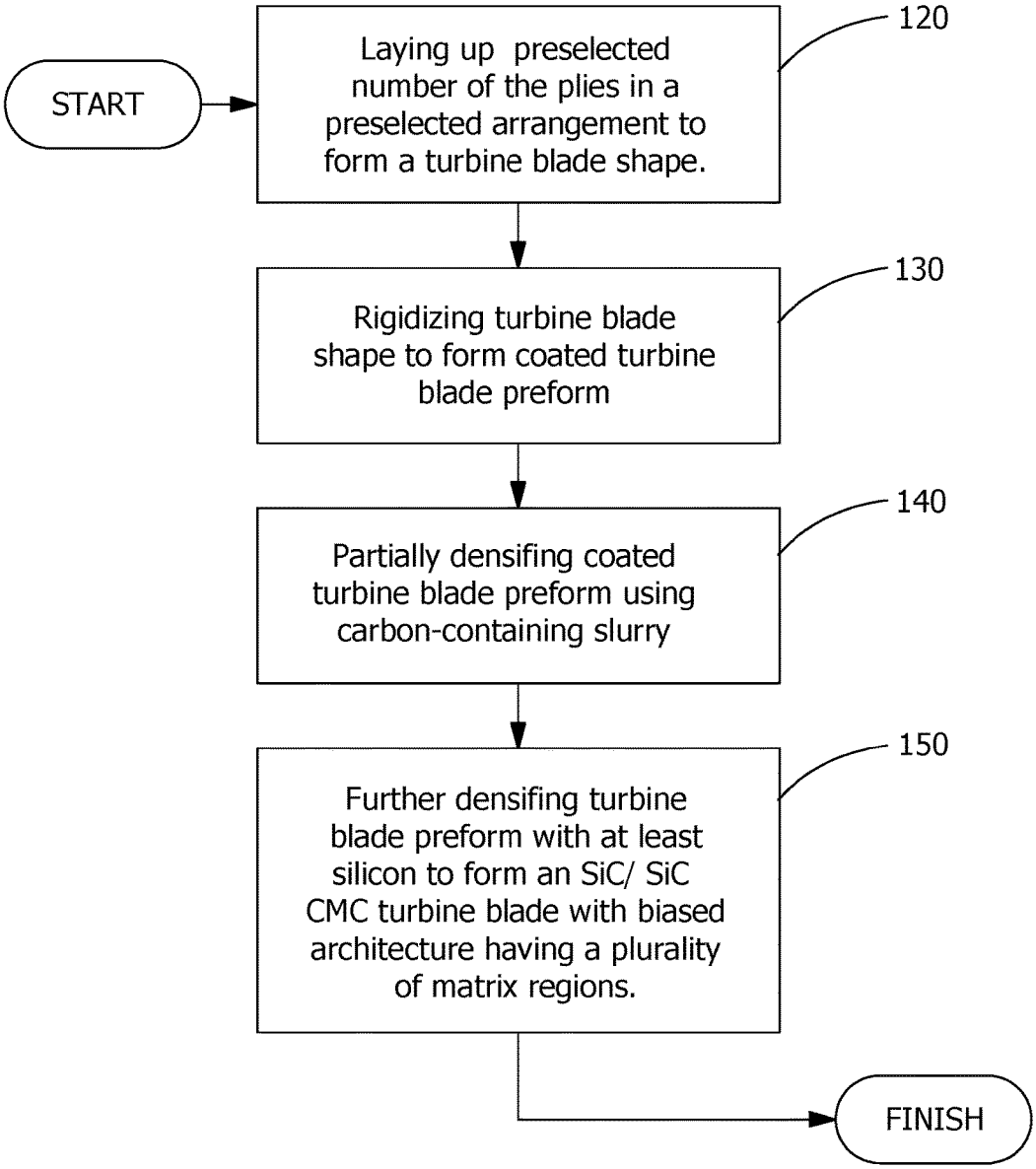
FIG. 2 is flow diagram of an exemplary turbine component fabrication process according to the disclosure.

The turbine component is fabricated by any suitable process. As shown in FIG. 2, in one embodiment, the turbine component is fabricated by a turbine component fabrication process 200 that includes laying up the ceramic matrix composite plies 302 in a preselected arrangement (step 202) and securing the feature 304 (step 204), for example, to prevent and/or relieve interlaminar tension between the ceramic matrix composite plies 302. In further embodiments, the process 200 further includes rigidizing (step 206) and/or densifying (step 208) of the ceramic matrix composite plies 302.

In one embodiment, the laying up of the ceramic matrix composite plies 302 in the preselected arrangement (step 202) includes positioning a preselected number of the matrix composite plies of a preselected geometry in the preselected arrangement to form the shape of the turbine component.

The rigidizing (step 206) is performed by any suitable process capable of at least partially retaining the shape of the turbine component. The rigidizing (step 206) is before, during, and/or after the feature 304 is secured (step 204). In one embodiment, the rigidizing (step 206) includes applying at least one of BN and SiC coatings using a chemical vapor infiltration (CVI) process, forming a rigid coated turbine component preform.

The densifying (step 208) is performed by any suitable process capable of at least partially hardening the turbine component. The densifying (step 208) is before, during, and/or after the feature 304 is secured (step 204). In one embodiment, the densifying is broken into a partial densifying sub-step and a final densifying sub-step. In this embodiment, the partially densifying includes introducing a carbon-containing slurry, into the coated turbine component preform. The final densifying includes densifying the turbine component preform with at least silicon, and in one embodiment boron-doped silicon, through a slurry cast melt infiltration process, forming the turbine component.

The feature 304 is secured (step 204) based upon the specific mechanism utilized for preventing interlaminar tension of the ceramic matrix composite plies 302. In general, embodiments of the turbine component have the feature 304 providing clamping/transverse shear capability, fiber control in predetermined regions (such as, a neck 102 of the turbine blade 100), mechanical interlocking, reduced porosity, toughening via in-situ mandrel, preventing and/or relieving out-of-plane stresses between the ceramic matrix composite plies 302 due to anisotropic features of the ceramic matrix composite plies 302, other suitable physical properties, and combinations thereof. In one embodiment of the turbine component being the turbine blade 100, the neck 102 includes a porosity that is lower than a porosity of the ceramic matrix composite plies 302.

Figure 3:
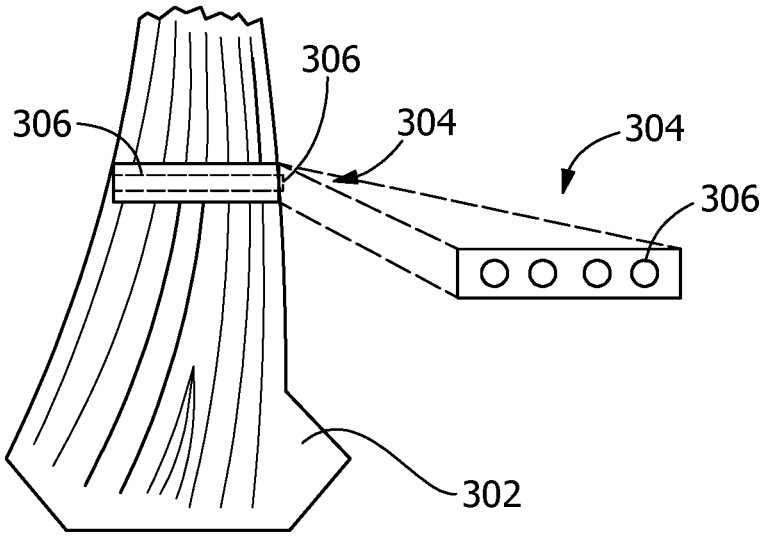
FIG. 3 is a sectioned view and a transverse view of an exemplary turbine component according to the disclosure.

FIG. 3 shows the feature 304 according to an embodiment of the turbine component. Specifically, in this embodiment, the feature 304 is or includes ceramic matrix composite tows 306 extending through at least a portion of the ceramic matrix composite plies 302, for example, providing a transverse, through the thickness, shear tie to prevent interlaminar separation. As used herein, the general term "tow" refers to a single fiber or a loose strand of essentially untwisted fibers that can be woven into a fiber bundle in the same manner as a single fiber; the fiber bundle acts substantially in the same manner as a single fiber. The ceramic matrix composite tows 306 extend through the ceramic matrix composite plies 302, and thus, the turbine component, in a transverse direction. For example, in one embodiment, the ceramic matrix composite tows 306 extend in a direction perpendicular to a suction side 104 (see FIG. 1) or a pressure side 106 (see FIG. 1) of the turbine blade 100. In a further embodiment, the ceramic matrix composite tows 306 are positioned in the neck 102 of the turbine blade 100. In one embodiment, one or more of the ceramic matrix composite tows 306 includes surface contoured regions for mechanical interlocking.

To fabricate the embodiment of the turbine component corresponding with FIG. 3, the ceramic matrix composite tows 306 are inserted through the ceramic matrix composite plies 302, for example, arranged as a stacked laminate of unidirectional tapes or multidirectional woven fabric and/or matrix layers. The inserting of the ceramic matrix composite tows 306 is after the rigidizing (step 206) but before the densifying (step 208) or at least a portion of the densifying (step 208).

Figure 4:
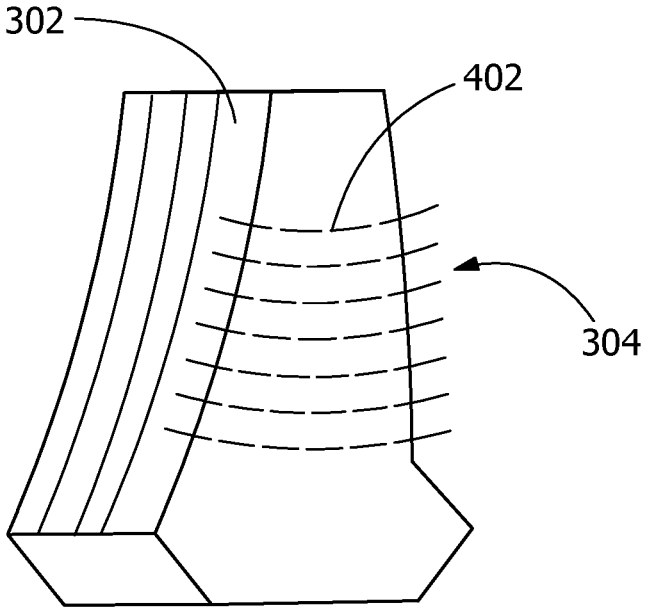
FIG. 4 is a sectioned view of an exemplary turbine component according to the disclosure.
Figure 5:
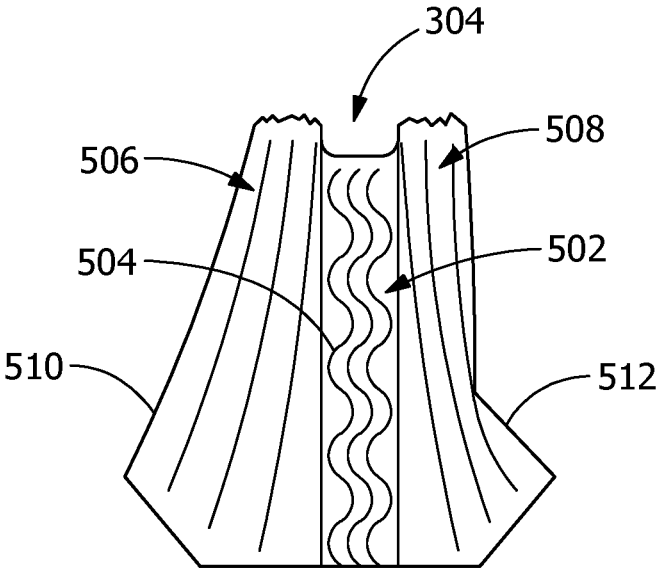
FIG. 5 is a sectioned view of an exemplary turbine component according to the disclosure.

FIG. 4 shows the feature 304 according to another embodiment of the turbine component. Specifically, in this embodiment, the feature 304 is or includes precast insert tows 402 extending through at least a portion of the ceramic matrix composite plies 302. In one embodiment, one or more of the precast insert tows 402 includes surface contoured regions for mechanical interlocking. Additionally or alternatively, the precast insert tows 402 extend through the ceramic matrix composite plies 302, thereby anchoring the ceramic matrix composite plies 302 and mechanical interlocking layers of the ceramic matrix plies 302. In one embodiment, as shown in FIG. 4, precast insert tows 402 projecting from a precast insert 602 (see FIG. 6) are inserted before the ceramic matrix plies 302 are rigidized to allow the ceramic matrix plies 302 to accept the 304 features and subsequently lock into them. In another embodiment, as shown in FIG. 5 that is further described below, the feature 304 is inserted either before or after rigidization depending on whether it is precast not. In another embodiment, as shown in FIG. 6 that is further described below, an in-situ mandrel provides interlaminar robustness and is inserted before the ceramic matrix plies 302 are rigidized to improve ply conformability to dovetail geometry and adhesion.

FIG. 5 shows the feature 304 according to another embodiment of the turbine component. Specifically, in this embodiment, the feature 304 is or includes a woven fabric 502 having fiber tows 504 preventing contact between a first set 506 of the ceramic matrix composite plies 302 and a second set 508 of the ceramic matrix composite plies 302. In addition, the woven fabric 502 includes interlocking stitches that run through the thickness of the fabric layers to literally tie them together and provide enhanced interlaminar strength. In one embodiment, one or more of the fiber tows 504 includes surface contoured regions for mechanical interlocking. In one embodiment, the first set 506 of the ceramic matrix composite plies 302 forms at least a portion of a suction skin 510 corresponding to the suction side 104 (see FIG. 1) of the turbine blade 100 (see FIG. 1) and the second set 508 of the ceramic matrix composite plies forms at least a portion of a pressure skin 512 corresponding to the pressure side 106 (see FIG. 1) of the turbine blade 100. In one embodiment, the suction skin 510 and/or the pressure skin 512 are positioned in a radial orientation with respect to the turbine blade 100, thereby reducing an out-of-plane load vector. In one embodiment, the turbine component includes an internal cavity (not shown), and the woven fabric 502 forms a border (not shown) of the internal cavity, for example, below a root 108 of the turbine blade 100.

Figure 6:
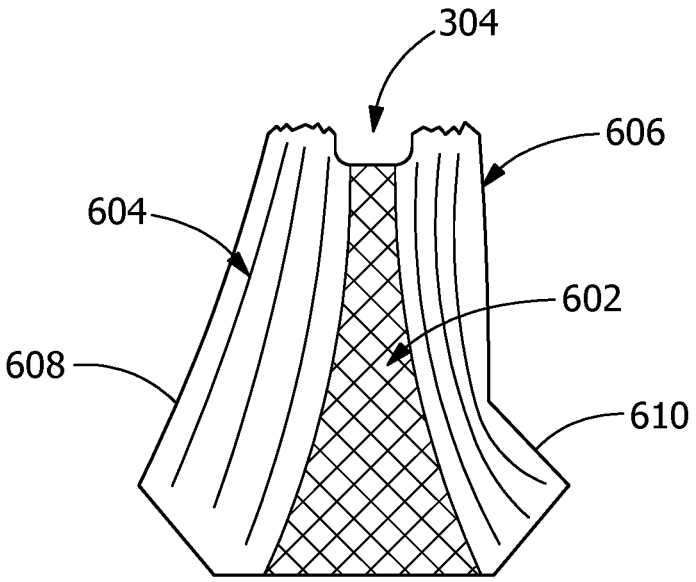
FIG. 6 is a sectioned view of an exemplary turbine component according to the disclosure.

FIG. 6 shows the feature 304 according to another embodiment of the turbine component. Specifically, in this embodiment, the feature 304 is or includes a precast insert 602 preventing contact between a first set 604 of the ceramic matrix composite plies 302 and a second set 606 of the ceramic matrix composite plies 302. In one embodiment, the first set 604 of the ceramic matrix composite plies 302 forms at least a portion of a suction skin 608 corresponding to the suction side 104 (see FIG. 1) of the turbine blade 100 (see FIG. 1) and a pressure skin 610 corresponding to the pressure side 106 (see FIG. 1) of the turbine blade 100 (see FIG. 1). In one embodiment, the suction skin 608 and/or the pressure skin 610 are positioned in a radial orientation with respect to the turbine blade 100, thereby reducing an out-of-plane load vector. In one embodiment, the turbine component includes an internal cavity (not shown), and the precast insert 602 forms a border (not shown) of the internal cavity, for example, below a root 108 (see FIG. 1) of the turbine blade 100 (see FIG. 1). In one embodiment, the precast insert 602 is a precast monolithic ceramic or whisker ceramic fiber-reinforced ceramic.

Figure 7:
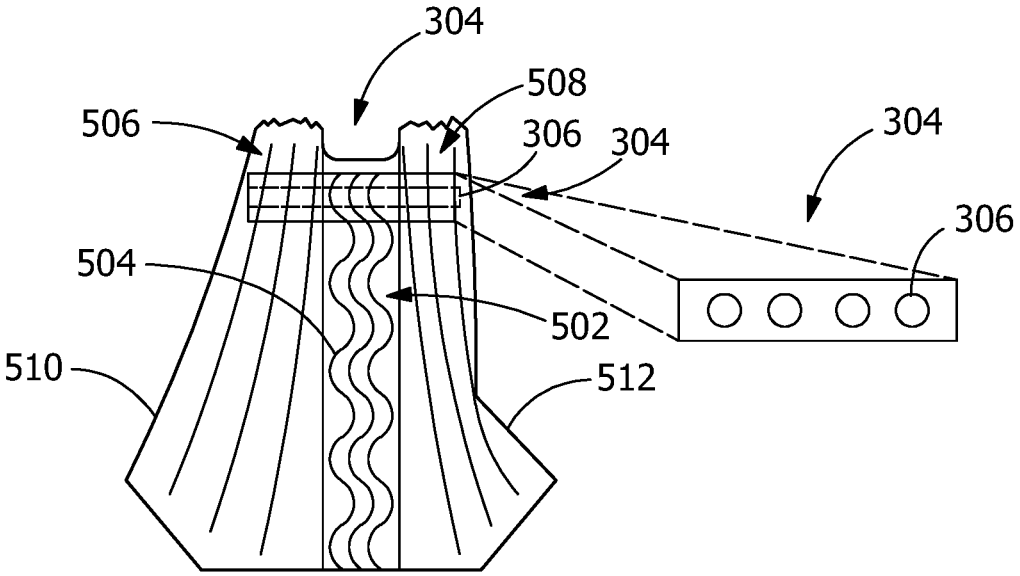
FIG. 7 is a sectioned view of an exemplary turbine component according to the disclosure.

FIG. 7 shows the feature 304 according to another embodiment of the turbine component. Specifically, in this embodiment, the feature 304 is or includes ceramic matrix composite tows 306 extending through at least a portion of the ceramic matrix composite plies 302, for example, providing a transverse, through the thickness, shear tie to prevent interlaminar separation and a woven fabric 502 having fiber tows 504 preventing contact between a first set 506 of the ceramic matrix composite plies 302 and a second set 508 of the ceramic matrix composite plies 302.

Figure 8:
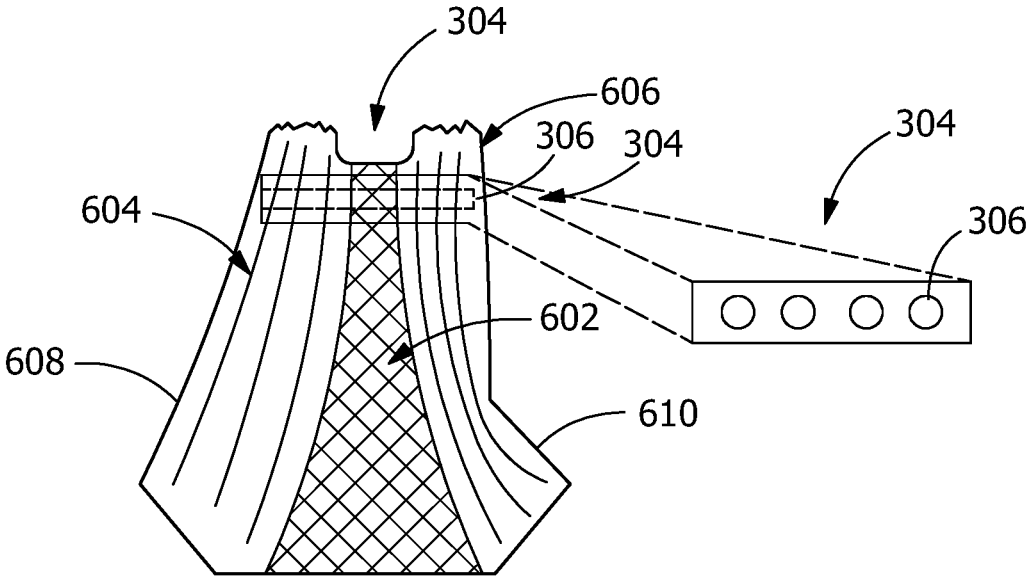
FIG. 8 is a sectioned view of an exemplary turbine component according to the disclosure.

FIG. 8 is a sectioned view of an exemplary turbine component according to the disclosure. Specifically, in this embodiment, the feature 304 is or includes ceramic matrix composite tows 306 extending through at least a portion of the ceramic matrix composite plies 302, for example, providing a transverse, through the thickness, shear tie to prevent interlaminar separation and a precast insert 602 preventing contact between a first set 604 of the ceramic matrix composite plies 302 and a second set 606 of the ceramic matrix composite plies 302.

Figure 9:
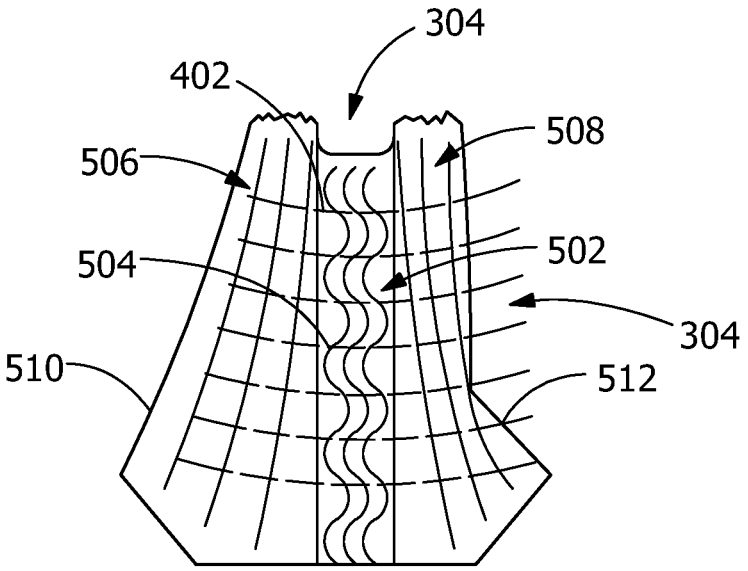
FIG. 9 is a sectioned view of an exemplary turbine component according to the disclosure.

FIG. 9 is a sectioned view of an exemplary turbine component according to the disclosure. Specifically, in this embodiment, the feature 304 is or includes precast insert tows 402 extending through at least a portion of the ceramic matrix composite plies 302 and a woven fabric 502 having fiber tows 504 preventing contact between a first set 506 of the ceramic matrix composite plies 302 and a second set 508 of the ceramic matrix composite plies 302. In one embodiment, one or more of the precast insert tows 402 includes surface contoured regions for mechanical interlocking.

Figure 10:
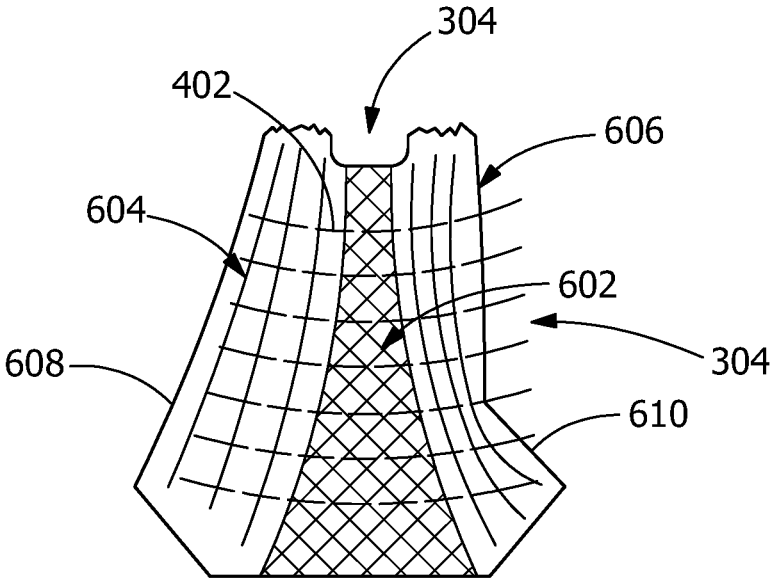
FIG. 10 is a sectioned view of an exemplary turbine component according to the disclosure.

FIG. 10 is a sectioned view of an exemplary turbine component according to the disclosure. Specifically, in this embodiment, the feature 304 is or includes precast insert tows 402 extending through at least a portion of the ceramic matrix composite plies 302 and a precast insert 602 preventing contact between a first set 604 of the ceramic matrix composite plies 302 and a second set 606 of the ceramic matrix composite plies 302. In one embodiment, one or more of the precast insert tows 402 includes surface contoured regions for mechanical interlocking.

Referring again to FIG. 1, in one embodiment, the turbine component includes a coating 110, such as an environmental barrier coating (EBC) on the ceramic matrix composite plies 302 and/or on the feature 304. In one embodiment, the EBC extends around the turbine component, such as, throughout the suction side 104 and the pressure side 106. The EBC includes any suitable number of layers or materials compatible with the ceramic matrix composite plies 302. The layer(s) of the EBC is/are applied by any suitable process capable of applying material to the ceramic matrix composite plies 302. For example, suitable processes include, but are not limited to, atmospheric plasma spray, reactive ion implantation, chemical vapor deposition, plasma-enhanced chemical vapor deposition, dip coating, electrophoretic deposition, or a combination thereof. Suitable layers are silicon-based and/or include silicon dioxide, such as, a bond coat providing chemical compatibility with ceramic matrix composites. Another suitable layer is a transition layer, such as, barium strontium aluminosilicate (BSAS), $(Yb,Y)_2Si_2O_7$, mullite with barium strontium aluminosilicate, or a combination thereof, providing resistance to water-vapor penetration, chemical compatibility with the bond coat, a coefficient of thermal expansion compatible with ceramic matrix composites, or a combination thereof. Another suitable layer is a top coat, such as, $Y_2SiO_5$ or barium strontium aluminosilicate, providing water-vapor recession and/or a coefficient of thermal expansion compatible with ceramic matrix composite plies 302. In further embodiments, the EBC includes a thermally grown oxide layer.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine component, comprising:

a first set of ceramic matrix composite plies forming at least a portion of a first side of the turbine component;

a second set of ceramic matrix composite plies forming at least a portion of a second side of the turbine component opposite the first side; and a woven fabric having fiber tows preventing contact between the first set of ceramic matrix composite plies and the second set of ceramic matrix composite plies;

wherein the woven fabric having fiber tows includes mechanically interlocking stitches running through a thickness of fabric layers of the woven fabric to tie the fabric layers together and provide enhanced interlaminar strength to the woven fabric and the fiber tows mechanically interlock in the woven fabric.

2. The turbine component of claim 1, wherein the turbine component comprises a turbine blade, the turbine blade comprising an internal cavity, wherein the woven fabric forms a border of the internal cavity below a root of the turbine blade.

3. The turbine component of claim 1, wherein the ceramic matrix composite plies include silicon carbide.

4. The turbine component of claim 1, further comprising an environmental barrier coating positioned on the ceramic matrix composite plies.

5. The turbine component of claim 1, wherein the woven fabric having fiber tows prevents contact between the first set of the ceramic matrix composite plies and the second set of the ceramic matrix composite plies at an edge of the turbine component to prevent interlaminar tension between the first set and the second set of ceramic matrix composite plies.

6. The turbine component of claim 1 further comprising a plurality of ceramic matrix composite tows extending in a transverse direction with respect to the ceramic matrix composite plies from and through at least a portion of the first set of ceramic matrix composite plies to and through at least a portion of the second set of ceramic matrix composite plies, the plurality of ceramic matrix composite tows serving as a transverse boundary to prevent interlaminar tension between the first set and the second set of ceramic matrix composite plies.

7. The turbine component of claim 1 further comprising a plurality of precast insert tows extending in a transverse direction with respect to the ceramic matrix composite plies from and through at least a portion of the first set of ceramic matrix composite plies to and through at least a portion of the second set of ceramic matrix composite plies, the plurality of precast insert tows serving as a transverse boundary to prevent interlaminar tension between the first set and the second set of ceramic matrix composite plies.

8. A turbine component fabrication process, comprising:

laying up a first set of ceramic matrix composite plies in a first preselected arrangement and a second set of ceramic matrix composite plies in a second preselected arrangement; and securing a plurality of ceramic matrix composite tows extending in a transverse direction with respect to the ceramic matrix composite plies from and through at least a portion of the first set of ceramic matrix composite plies to and through at least a portion of the second set of ceramic matrix composite plies, the plurality of ceramic matrix composite tows serving as a transverse boundary to prevent interlaminar tension between the first set and the second set of ceramic matrix composite plies;

wherein the first set of ceramic matrix composite plies forms at least a portion of a first side of the turbine component and the second set of ceramic matrix composite plies forms at least a portion of a second side of the turbine component opposite the first side.

9. The turbine component fabrication process of claim 8, wherein the turbine component is a turbine blade, wherein the first side comprises a suction skin of the turbine blade and the second side comprises a pressure skin of the turbine blade.

10. The turbine component fabrication process of claim 9, wherein the ceramic matrix composite tows are positioned in a neck of the turbine blade.

11. The turbine component fabrication process of claim 9, wherein the turbine blade is solid.

12. The turbine component fabrication process of claim 8, further comprising rigidizing and densifying the ceramic matrix composite plies.

13. The turbine component fabrication process of claim 8 further comprising preventing contact between the first set of ceramic matrix composite plies and the second set of ceramic matrix composite plies with a precast insert.

14. A turbine component, comprising:

a first set of ceramic matrix composite plies forming at least a portion of a first side of the turbine component;

a second set of ceramic matrix composite plies forming at least a portion of a second side of the turbine component opposite the first side;

a plurality of precast insert tows extending in a transverse direction with respect to the ceramic matrix composite plies from and through at least a portion of the first set of ceramic matrix composite plies to and through at least a portion of the second set of ceramic matrix composite plies, the plurality of precast insert tows serving as a transverse boundary to prevent interlaminar tension between the first set and the second set of ceramic matrix composite plies.

15. The turbine component of claim 14, wherein the precast insert tows mechanically interlock with the portion of the first set of ceramic matrix composite plies and the portion of the second set of ceramic matrix composite plies.

16. The turbine component of claim 14 further comprising a precast insert preventing contact between the first set of ceramic matrix composite plies and the second set of ceramic matrix composite plies.

17. The turbine component of claim 16, wherein the precast insert is a precast monolithic ceramic or whisker ceramic fiber-reinforced ceramic.

18. The turbine component of claim 14, wherein the turbine component comprises a turbine blade, wherein the first side comprises a suction skin of the turbine blade and the second side comprises a pressure skin of the turbine blade.

19. The turbine component of claim 18, wherein the suction skin and the pressure skin are positioned in a radial orientation to reduce an out of plane load vector.

* * * * *